US009999984B2

(12) United States Patent
Wilhelm et al.

(10) Patent No.: US 9,999,984 B2
(45) **Date of Patent: *Jun. 19, 2018**

(54) CIRCULAR CUTTING BLADE

(71) Applicant: HYDE TOOLS, Inc., Southbridge, MA (US)

(72) Inventors: Eric C. Wilhelm, Southbridge, MA (US); Richard M. Clemence, Southbridge, MA (US); William Hill, Ball Ground, GA (US); Richard N. Cloutier, Woodstock, CT (US)

(73) Assignee: HYDE TOOLS, INC., Southbridge, MA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/375,534

(22) Filed: Dec. 12, 2016

(65) Prior Publication Data

US 2017/0190067 A1 Jul. 6, 2017

Related U.S. Application Data

(63) Continuation-in-part of application No. 12/930,006, filed on Dec. 23, 2010, now Pat. No. 9,517,571.

(60) Provisional application No. 61/336,782, filed on Jan. 26, 2010.

(51) Int. Cl.

| | |
|---|---|
| ***B27B 33/08*** | (2006.01) |
| ***B26D 1/14*** | (2006.01) |
| ***B26D 1/00*** | (2006.01) |

(52) U.S. Cl.

CPC ..... *B26D 1/14* (2013.01); *B26D 1/0006* (2013.01); *B26D 2001/006* (2013.01); *B26D 2001/0046* (2013.01); *B26D 2001/0053* (2013.01)

(58) Field of Classification Search

CPC ..... B26D 1/0006; B26D 1/14; B26D 2001/0046; B26D 2001/0053; Y10T 83/9403

USPC ..... 83/676, 835–855, 932; 30/355

See application file for complete search history.

(56) References Cited

U.S. PATENT DOCUMENTS

| | | | | |
|---|---|---|---|---|
| 9,517,571 | B2 * | 12/2016 | Wilhelm | B26D 1/0006 |
| 2013/0192441 | A1 * | 8/2013 | Ehrle | B23K 10/027 83/651 |

* cited by examiner

*Primary Examiner* — Omar Flores Sanchez

(74) *Attorney, Agent, or Firm* — Louis J. Franco; Law Office of Louis J. Franco

(57) ABSTRACT

A circular cutting blade is configured for cutting meat when turned about a rotation axis in a predetermined cutting direction. The cutting blade has a peripheral blade edge defined between the first and second sides and a plurality of circumferentially disposed cutting knives. Each cutting knife includes first and second knife sides and an arcuate knife edge that constitutes a portion of the peripheral blade edge. Each knife edge is titled and rises, relative to the rotation axis, between a first blade-edge location corresponding to a minor blade radius and a second blade-edge location corresponding to a major blade radius such that, when the circular blade is rotating in the predetermined cutting direction and cutting a work piece, the work piece first encounters the first blade-edge location of each cutting knife before encountering the second blade-edge location of that cutting knife.

5 Claims, 2 Drawing Sheets

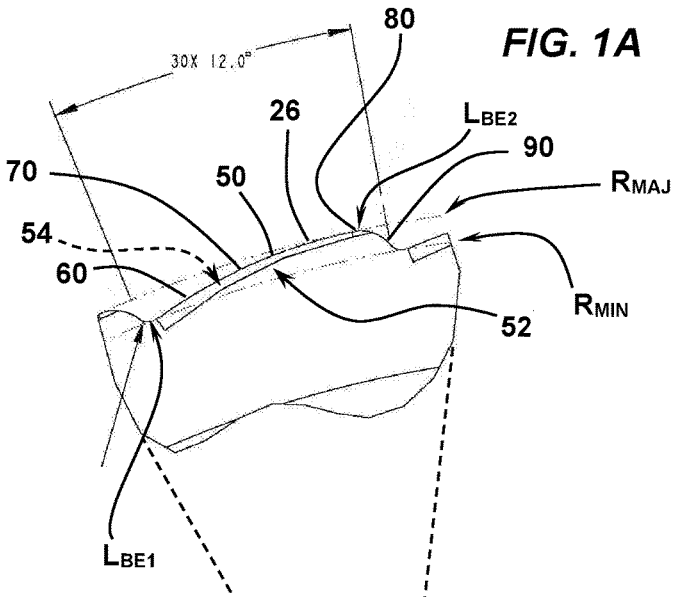
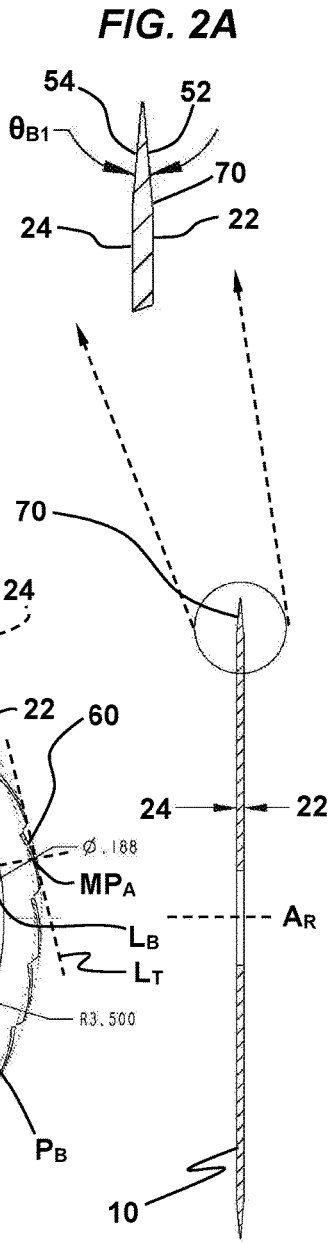
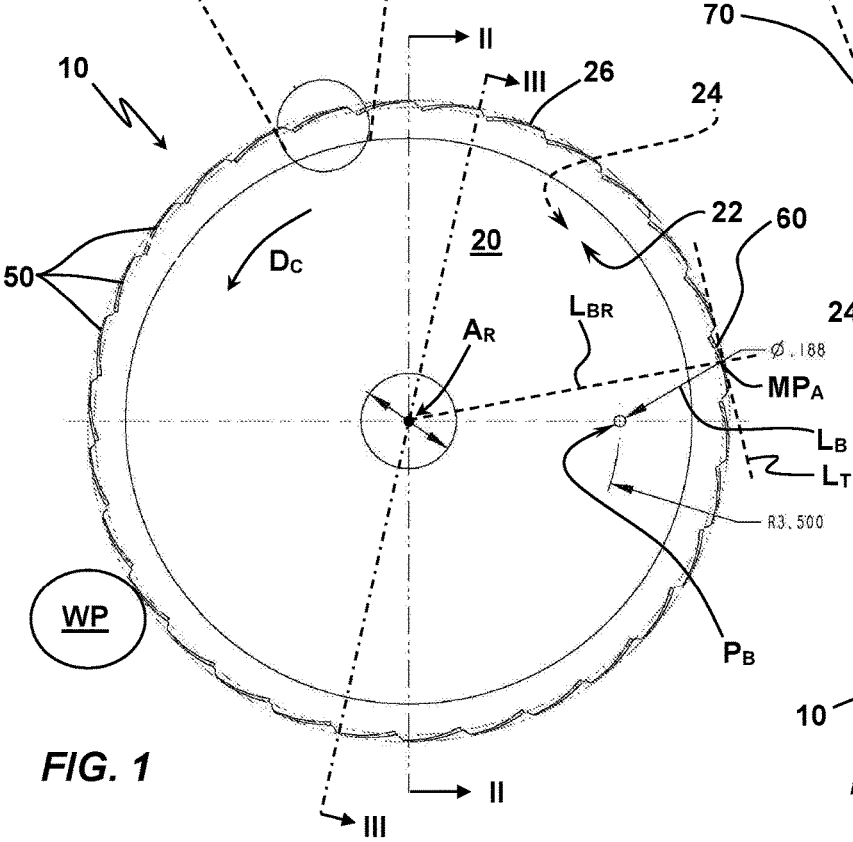
FIG. 1
FIG. 2

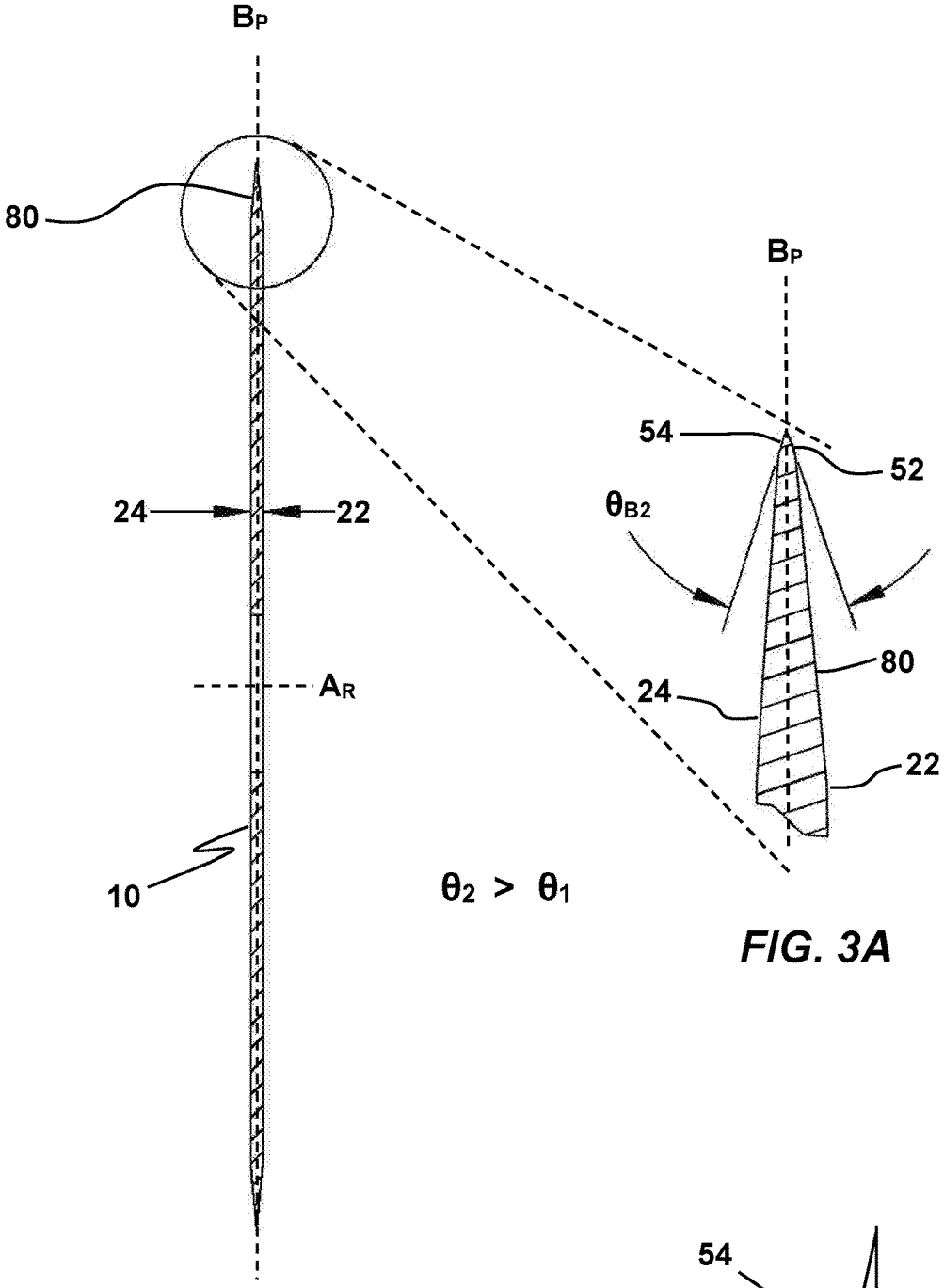
FIG. 3A
FIG. 3
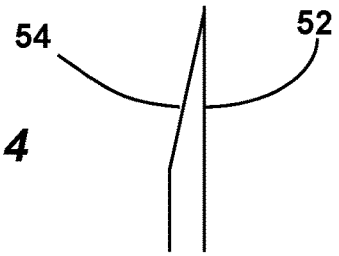
FIG. 4

CIRCULAR CUTTING BLADE

CROSS-REFERENCE TO RELATED APPLICATIONS/PRIORITY CLAIMS

The present application is a continuation-in-part of U.S. application Ser. No. 12/930,006 filed Dec. 23, 2010 under the title "CIRCULAR CUTTING BLADE," and for which a Notice of Allowance was issued on Aug. 10, 2016. Application Ser. No. 12/930,006 was co-pending with the present application on the date the present application was filed.

Previously filed Non-provisional application Ser. No. 12/930,006 was based on, and claimed the benefit of the filing date of, Provisional Application Ser. No. 61/336,782, filed on Jan. 26, 2010 under the title "CIRCULAR CUTTING BLADE." The present application also claims the benefit of the filing date of Provisional Application Ser. No. 61/336,782 through Non-provisional application Ser. No. 12/930,006. Moreover, the entirety of the disclosures of the previous non-provisional and provisional applications, including the drawings, are incorporated herein by reference as if set forth fully in the present application.

BACKGROUND

Traditionally, circular meat saw blades, such as those to cut poultry, are of two general types. Included within a first type of meat blade are blades that end consumers observe at deli counters. Circular deli-style blades are used to cut products such as cheese, processed meats, such as "cold cuts," and pre-cooked non-processed meats, such as ham and turkey. Circular deli blades are typically characterized by a sharp, beveled cutting edge, as viewed into a cross-sectional plane that includes the rotation axis, and a constant, circular radius as viewed from either side. Blades of this first type are generally unsuitable for use in the initial butchering stages in which the meats being cut are raw and include bone, cartilage, tendon, and non-edible soft tissue.

In order to butcher meats, including poultry, shortly after slaughter, a second type of circular meat saw blade is used. As viewed from either side, a circular blade of the second type is typically marked by a plurality of circumferentially disposed U-shaped notches that are convex relative to the rotation axis of the blade. The particular purpose for which such a blade is designed is a factor in determining how deep the notches are defined and for what length each extends along the circumference of the blade. As a general proposition, however, it is known in the meat industry that such blades, while robust and sufficiently "aggressive" to cut through bone and cartilage, for example, result in non-negligible losses of otherwise edible and salable meat product. This undesired shredding and "tearing off" of meat is currently factored as a price of doing business.

Accordingly, there exists a need for a circular meat cutting blade that, while sufficiently robust to cut through animal bone and cartilage, minimizes the loss of meat product associated with traditional meat cutting blades.

SUMMARY

In each of various alternative embodiments, a circular cutting blade, such as a meat saw blade, is configured for unidirectional rotation about an axis in a predetermined cutting direction. The blade comprises a substrate with first and second substrate sides. A peripheral blade edge is defined between the first and second sides and by a plurality of circumferentially disposed cutting knives.

Each cutting knife includes first and second knife sides corresponding with, respectively, the first and second substrate sides, and an arcuate knife edge. In one embodiment, the first and second knife sides are defined portions of, respectively, the first and second substrate sides. The knife edge of each cutting knife rises, relative to the rotation axis, between a first blade-edge location corresponding to a minor blade radius and a second blade-edge location corresponding to a major blade radius.

Defined along the knife edge of each cutting knife are beveled primary and secondary knife-edge portions. Along the primary knife-edge portion, the first and second knife sides mutually converge at a first bevel angle. Distinguishably, along the secondary knife-edge portion, the first and second knife sides mutually converge at a second bevel angle that is larger (i.e., less acute) than the first bevel angle.

In various versions, the secondary knife-edge portion of each cutting knife is situated behind the primary knife-edge portion such that, relative to the cutting direction, each primary knife-edge portion leads the secondary knife-edge portion of the same knife into a work piece (e.g., meat or bone) to be cut. Stated alternatively, when the blade is rotated in the cutting direction, a fixed external point located adjacent the peripheral blade edge (e.g., a work piece or a location on a work piece) is encountered first by the primary knife edge of each cutting knife or, more generally in, for example, versions in which each cutting knife lacks distinct primary and secondary knife-edge portions or disparate bevel angles, by the first blade-edge location corresponding to the minor blade radius.

While in some configurations each primary knife-edge portion is "sharper" than the secondary knife-edge portion of the same knife, as defined by the relativity of the first and second bevel angles, it is also not as strong. Moreover, due to the "rise" of each arcuate knife edge, the (radially directed) force between the work piece and the knife edge increases from an initial magnitude when the knife edge first enters the work piece. By situating the sharper primary knife-edge portion forward of the secondary knife-edge portion, an initial cut is made in the work piece by the sharper portion of the knife, while, as the forces increase, the secondary knife-edge portion "takes over" and adds a finishing cut to the initial cut. In other words, initially, the benefit of a sharper edge is realized when the forces are relatively low, while the benefit of a stronger (duller) edge are realized when the forces are relatively high.

Among the benefits of the prescribed locations of the primary and secondary knife-edge portions, and the configuration of same, is prolonged blade life. However, various embodiments within the scope and contemplation of the invention are configured for use in the meat industry, generally, and the poultry industry, more particularly. The aforementioned configuration and arrangement of the primary and secondary knife-edge portions obviates the tearing of meat associated with existing blades and, therefore, results in cleaner, less wasteful cuts.

Upon initial inspection, embodiments of the present circular cutting blade might appear patentably indistinct from prior rotary cutting blades such as, for example, those disclosed in U.S. Pat. No. 5,713,259 to Haanschoten (hereinafter, Haanschoten or "the '259 patent") and U.S. Pat. No. 139,176 to Miller (hereinafter, Miller or "the '176 patent"). A discussion in turn of each of the '259 and '176 patents is warranted in order to render clear how they differ radically from the present circular cutting blade.

Referring first to the '259 patent, it is critically important to understand that Haanschoten is drawn to a saw blade, while the present application is drawn, in substance, to what amount to rotary knives. Although the present Applicants used the terminology "saw" and "saw blade" in the specification of parent application Ser. No. 12/930,006, and do so in the present specification as well, this is more a function of the adoption of "looser parlance" in the relevant industry than a proper descriptor of actual functionality. It is otherwise plain from the functional description of Applicants' cutting blade that the periphery is defined by knives, and not teeth. The distinction is far more than a matter of phraseology.

A rotary saw blade, such as a blade rotated in a table or hand-held circular saw, operates on a very different principle than that of a knife. Whereas, by design, saw teeth actually remove ("notch out") material from a work piece being cut in incremental, but macroscopic chunks or chips (i.e., saw dust), the cutting edges of knives are defined by tapered or beveled knife sides that form a sharp edge that slices and parts the material of the work piece with very little incident loss of material. The operative difference lies in the fact that, while a rotary saw blade tooth also includes a beveled cutting edge, the cutting edge extends transversely to the direction of the cut through a work piece, as shown in the Haanschoten patent. In contrast, the cutting edges of Applicants' knives are within or parallel to the plane of the overall blade. This is a principal reason why saw teeth are well suited to cutting relatively rigid substrates such as wood and plastic, while knives are more suited to cutting less rigid and deformable materials such as non-hardened clay, fruit, vegetables, and raw or cooked meat. Hence, one would not look to a saw blade for an improved solution associated with tasks traditionally handled by knives; in this case, cutting (i.e., by slicing) meat. Accordingly, the saw teeth of Haanschoten are not interchangeable with the knives of Applicants' circular cutting blade.

A related—but still independent—basis of distinction between Haanschoten and the cutting blade defined in claims appended hereto is the cutting direction of the circular blades relative to both or either of a work piece being cut and the structural configurations of the individual cutters (i.e., the saw teeth in Haanschoten and the cutting knives in Applicants' case). Although it has already been established that the cutters in Haanschoten are not knives, but saw teeth, the teeth of Haanschoten and the knives of Applicants' cutting blade are, for the limited purposes of discussing rotation direction, both referred to as "cutters." Relative to the cutters, it may be fairly observed that, like Applicants' circular cutting blade, Haanschoten's saw disc includes portions corresponding to a "minor blade radius" and a "major blade radius" located at or near, respectively, the section of each cutter 2 close to the edge 7 and the section of each cutter 2 close to the recess 3. However, more clearly explained below is the fact that, while each circular blade is absolutely unidirectional, relative to the portions of their respective cutters corresponding to minor and major blade radii, the circular blades of Haanschoten and Applicants must rotate in mutually opposite directions.

Referring to FIG. 1 of the '259 patent, in order to function, the Haanschoten saw disc rotates clockwise. This must be the case because (i) the Haanschoten blade is a saw blade with saw teeth and (ii) because, although Haanschoten does not label the rotation direction in the drawings, Haanschoten provides several indications throughout his specification that the cutting direction would be clockwise as viewed from the side shown in FIG. 1. Referring to Haanschoten's FIG. 1, cutting edges 5 represent the regions of the disc 1 (saw blade) corresponding to the "major blade radius," which, in the present Applicants' case, are defined to correlate with the "secondary knife-edge portion." In order for Haanschoten to cut, each cutting edge 5 rotates into a work piece and, in a quick, instantaneous strike, notches out a hunk of the work piece. The remainder of the tooth 2, including the edge 7 that correlates with Applicants' "minor blade radius" and "primary knife-edge portion," then passes through the groove created in the work piece by the cutting edge 5 and does not contribute to the cutting of the work piece. These facts establish that, in Haanschoten, the secondary knife-edge portion of each cutting tooth is actually situated, relative to the cutting direction, forward of the primary knife-edge portion of the same tooth, and not behind. Stated alternatively, a work piece being cut by the Haanschoten disc first encounters the part of each cutter corresponding to Applicants' "secondary knife-edge portion of each cutting knife" before encountering the part of each cutter corresponding to Applicants' "primary knife-edge portion of that cutting knife."

At least relative to the highly distinguishable Haanschoten reference, it might be fairly observed that Miller's rotary paper cutter shares some limited similarity with configurations of the present invention, but it is nevertheless distinguishable in several material respects. More specifically, it could be said of Miller that each cutting edge a, a', a", and a"" individually correlates structurally and functionally to one of Applicants' circumferential cutting knives. However, in combination Miller's cutting edges a, a', a", and a"" function very differently from Applicants' circumferential cutting knives.

With principal reference to his FIGS. 2 and 3, page 2, col. 1, at paragraph 4, Miller explains in relevant part "[t]he invention . . . also consists in the blades being beveled on alternate opposite faces of the sections whereby the knife cuts with ease, and binding therefore is overcome . . . ," and, page 2, col. 2, beginning at line 3, " . . . [t]he sides of the sections are beveled to form the sharp or cutting edges, and the bevels alternate or are respectively formed on opposite sides of the section—that is to say, the sections C E are beveled on the one or same side, and the sections B D on the other side, so that there are produced two series of cutting-edges. (See FIG. 2)." (emphasis added). The reasoning for the distinct, mutually offset series of cutting-edges is explained by Miller in the second full paragraph at page 2, col. 2 thusly: "Again, the two distinct series of beveled edges form a groove in the article, so that there is no binding with the article—a disadvantage well known in the operation of cutting articles of great compactness and friction, especially of numerous sheets of paper, cork . . . ."

As claimed, various embodiments of Applicants' circular cutting blade recite "a single overall peripheral blade edge." Moreover, each circumferential cutting knife is defined such that it includes "first and second knife sides that (i) are defined by portions of, respectively, the first and second substrate sides and (ii) which define a beveled, arcuate knife edge that constitutes a portion of the overall peripheral blade edge." Accordingly, it is clear that there is a single peripheral blade edge and both knife sides of all of the knives are directed toward and meet at that single blade edge. That both knife sides of all of the knives meet at a single overall peripheral blades edges is true even though, in some cases, each cutting knife is "doubled beveled," while, other cases, each cutting knife is "single beveled." More specifically, in a first bevel configuration of the present invention, "all of the cutting knives are uniformly configured such that the first and second knife sides of each cutting knife are both non-parallel to the blade plane and mutually converge to define a double bevel terminating at, and defining, the arcuate knife edge of that cutting knife and a portion of the single overall peripheral blade edge." In contrast, while all of the cutting knives in a second bevel configuration are also "uniformly configured . . . and define a portion of the single overall peripheral blade edge," they differ from the cutting knives of the first bevel configuration in that "the first knife side of each cutting knife is parallel to the blade plane while the second knife side of that cutting knife is non-parallel to the blade plane and angled toward the first knife side such that the first and second knife sides converge to define a single bevel terminating at, and defining, the arcuate knife edge of that cutting knife and a portion of the single overall peripheral blade edge."

In addition to the literal structural distinctions between Miller and the present circular cutting blade, it is important to note that Miller does not inform a solution to the problem that Applicants seek to address and, in fact, would very much frustrate a central purpose of the cutting blade. More specifically, as stated in the final paragraph of the BACKGROUND above, "there exists a need for a circular meat cutting blade that, while sufficiently robust to cut through animal bone and cartilage, minimizes the loss of meat product . . . " In other words, a main objective of various versions of the present circular cutting blade is to minimize waste of good meat product. Because Miller's design is specifically configured to "form a groove in the article" being cut, it would be wholly unsuitable as a solution to Applicants' objective of minimizing waste; the material removed to form the groove would be thrown from the spinning cutting blade and wasted. Conversely, Applicants' very deliberate "single peripheral blade edge" at which all cutting knives meet would be unsuitable in obviating the binding issue identified by Miller. Miller's and Applicants' cutting blades are configured for cutting two very different types of material, and neither is well-suited for cutting the types of materials for which the other is designed. Whereas Miller's blade is specifically configured for cutting "articles of great compactness and friction, especially of numerous sheets of paper . . . ," Applicants' cutting blade is configured for cutting meat, cartilage and some bone. Meat does not exhibit "great compactness and friction," and bone is generally hollow and somewhat porous in composition.

Representative embodiments are more completely described and depicted in the following detailed description and the accompanying drawings.

BRIEF DESCRIPTION OF THE DRAWINGS

FIG. 1 is a side view of a circular cutting blade;

FIG. 1A is a detail view of the blade portion indicated in FIG. 1;

FIG. 2 is a cross-sectional view into the plane II of FIG. 1;

FIG. 2A is a detail view of the sectional blade portion indicated in FIG. 2;

FIG. 3 is a cross-sectional view into the plane III of FIG. 1;

FIG. 3A is a detail view of the sectional blade portion indicated in FIG. 3; and FIG. 4 is a cross-sectional view of a cutting knife in which the knife sides converge in a single bevel.

DETAILED DESCRIPTION

The following description of variously embodied circular cutting blades is demonstrative in nature and is not intended to limit the invention or its application of uses. Accordingly, the various implementations, aspects, versions and embodiments described in the summary and detailed description are in the nature of non-limiting examples falling within the scope of the appended claims and do not serve to define the maximum scope of the claims.

With initial reference to FIG. 1, an illustrative circular cutting blade 10 is configured for cutting a work piece WP when turned about a rotation axis $A_R$ in a predetermined cutting direction $D_C$ which, in FIG. 1, is indicated as counterclockwise. The cutting blade 10 comprises a planar substrate 20 having opposed first and second substrate sides 22 and 24, and a peripheral blade edge 26 defined between the first and second sides 22 and 24. In various illustrative versions, the substrate 20 is fabricated from a rigid, wear-resistant material such as steel, or alternative metal, or a ceramic, by way of non-limiting example.

As shown in FIG. 1 and the detail view of FIG. 1A, the substrate 20 has formed thereon a plurality of circumferentially disposed cutting knives 50. Each cutting knife 50 includes first and second knife sides 52 and 54 corresponding with, respectively, the first and second substrate sides 22 and 24, and an arcuate knife edge 60 that constitutes a portion of the overall peripheral blade edge 26 and is oriented such that the arc defined thereby is concave relative to the rotation axis $A_R$. Alternatively stated, each cutting knife 50 presents a convex arcuate knife edge 60 to a work piece WP undergoing cutting.

In various versions, the arcuate knife edges 60 are circular arcs. Irrespective of constancy in the radius of curvature, however, the arcuate knife edge 60 of each cutting knife 50 is "tilted" relative to the rotation axis $A_R$ such that the knife edge 60 rises between a first blade-edge location $L_{BE1}$ corresponding to a minor blade radius $R_{MIN}$ and a second blade-edge location $L_{BE2}$ corresponding to a major blade radius $R_{MAJ}$. For example, in an illustrative version in which each knife edge 60 defines a circular arc, the knife edge 60 is "tilted" such that a radial arc-bisecting line $L_B$ that bisects the knife edge 60 at an arc mid-point $MP_A$ (i) has as its origin a point $P_B$ that does not spatially coincide with the rotation axis $A_R$ and (ii) is non-parallel with a blade radius line $L_{BR}$ extending from the rotation axis $A_R$ through the arc mid-point $MP_A$. Stated more generally for the inclusion of cases in which a knife edge 60 defines a non-circular arc, the knife edge 60 is tilted such that an arc-bisecting line $L_B$ that bisects that arcuate knife edge 60 at an arc mid-point $MP_A$, and that is oriented orthogonally to a tangent line $L_T$ including the arc mid-point $MP_A$, is non-parallel to a blade-radius line $L_{BR}$ extending from the rotation axis $A_R$ through the arc mid-point $MP_A$.

As indicated most clearly in FIG. 1A, each cutting knife 50 of some configurations further includes beveled primary and secondary knife-edge portions 70 and 80. As shown in FIG. 2, which is a cross-sectional view into the plane II of FIG. 1, and the detail view of FIG. 2A, the primary knife-edge portion 70 is beveled such that the first and second knife sides 52 and 54 mutually converge at a first bevel angle $\theta_{B1}$. However, as shown in FIG. 3, which is a cross-sectional view into the plane III of FIG. 1, and the detail view of FIG. 3A, along the secondary knife-edge portion 80, the first and second knife sides 52 and 54 mutually converge at a second bevel angle $\theta_{B2}$ that is less acute than the first bevel angle $\theta_{B1}$. Although the examples of FIGS. 2 through 3A depict the first and second knife sides 52 and 54 converging symmetrically about the blade plane $B_P$ in a so-called "double bevel," it is to be understood that, absent express limitations to the contrary, the invention as defined in the appended claims is not so limited. For example, within the scope of various claims is the "single bevel" version of FIG. 4 in which the first knife side 52 is parallel to the blade plane $B_P$, while the second knife side 54 is angled toward the first knife side 52. In the broadest aspects of the invention, therefore, the only condition that need be met is that the first and second knife sides 52 and 54 mutually converge to define a bevel which, in illustrative alternative versions, is a double bevel or single bevel.

In the particular version shown in FIGS. 1 and 1A, the secondary knife-edge portion 80 of each cutting knife 50 has a shorter cutting length than the primary knife-edge portion 70 of the same cutting knife 50. However, it is to be generally understood that the version of FIGS. 1 and 1A is merely illustrative and, more particularly understood, that, absent explicit limitations to the contrary, within the scope and contemplation of the invention as defined in the appended claims are versions in which the cutting length of the secondary knife-edge portion 80 is equal to or greater than the cutting length of the primary knife-edge portion 70.

Although more-than-implicit in the aforesaid explanation, it is also to be explicitly understood that within the scope and contemplation of the invention are embodiments in which the bevel angle is configured to be constant between the first blade-edge location $L_{BE1}$ corresponding to the minor blade radius $R_{MIN}$ and the second blade-edge location $L_{BE2}$ corresponding to the major blade radius $R_{MAJ}$. Since this scenario is not only implicit, but readily imagined, the existing figures are deemed sufficiently supportive of such cases; constancy of the bevel angle along each cutting knife 50 can be conceptualized as a case in which the first bevel angle $\theta_{B1}$ is equal to the second bevel angle $\theta_{B2}$ and, consequently, in which there is an arbitrariness on referencing primary and secondary knife-edge portions 70 and 80. Accordingly, in most such cases, rather than reference primary and secondary knife-edge portions 70 and 80, reference is made instead to the first blade-edge location $L_{BE1}$ corresponding to the minor blade radius $R_{MIN}$ and the second blade-edge location $L_{BE2}$ corresponding to the major blade radius $R_{MAJ}$ where doing so is required or desirable in making sense of cutting direction and "tilt" of the knife edge 60 of each cutting knife 50, for example.

With continued reference to FIGS. 1 and 1A, the peripheral blade edge 26 further includes a back slope 90 situated between first and second cutting knives 50 of each set of two adjacent cutting knives 50. Furthermore, each back slope 90 is situated, relative to the cutting direction $D_C$, behind the secondary knife-edge portion 80 of a first cutting knife 50 and in front of the primary knife-edge portion 70 of a second cutting knife 50 located behind, and adjacent to, the first cutting knife 50. Although no particular profile of a back slope 90 is shown as viewed into cross-sectional plane including the blade rotation axis $A_R$, such as planes II and III, for example, the back slopes 90 between cutting knives 50 of a first version are non-beveled while, in a second version, the back slopes 90 are beveled. It will be appreciated that non-beveled back slopes 90 contribute strength and rigidity to the peripheral blade edge 26. Moreover, as with the version of FIGS. 1 and 1A, a typical version is configured such that, as viewed from either side of the cutting blade 10, each back slope 90 slopes more steeply (less gradually) than the rates at which the knife edges 60 between which that back slope 90 is situated rise.

As seen in the version of FIGS. 1 and 1A, each back slope 90 behind a first cutting knife 50, and in front of a second cutting knife 50, is not profiled so as to "curl under" any portion of the first cutting knife 50 behind which it is situation relative to the cutting direction $D_C$, an aspect of the configuration that contributes to strength and rigidity. So, for instance, it can be readily envisioned that a blade radius line $L_{BR}$ extending from the rotation axis $A_R$ could pass through a back slope 90 of the illustrative configuration of FIGS. 1 and 1A without passing through or touching the cutting knife 50 forward of or behind that back slope 90. Although a single blade radius line $L_{BR}$ is shown in FIG. 1, there is not one shown passing through a back slope 90 as described. Inclusion of another blade radius line $L_{BR}$ was avoided in order to prevent crowding in the drawing and because its inclusion is deemed unnecessary in order to support its disclosure in light of the blade radius line $L_{BR}$ that is shown in combination with the explanation provided above. Imagining that there is an infinite number of blade radius lines $L_{BR}$ emanating from the rotation axis $A_R$ toward and through an equally infinite number of corresponding points along the overall peripheral blade edge 26 is well within the intellectual compass of a person of ordinary skill in the art to which the invention pertains.

Because the unidirectionality of the cutting blade 10 is so critical to its functionality, and in distinguishing it from existing rotary cutting blades, a more exhaustive explanation in this regard is warranted. The predetermined cutting direction $D_C$ can be conceptualized with reference to either or both of a work piece WP external to the cutting blade 10 and the configurations of the cutting knives 50 themselves. With an eye toward maximizing clarity, the necessary unidirectionality of the cutting blade 10 is explained both ways. Moreover, for purposes of discussing cutting direction $D_C$ relative to a broader configuration of the cutting blade 10, reference is made to the first blade-edge location $L_{BE1}$ corresponding to the minor blade radius $R_{MIN}$ and the second blade-edge location $L_{BE2}$ corresponding to the major blade radius $R_{MAJ}$ since these locations are present in every version, regardless of whether any particular version also includes primary and secondary knife-edge portions 70 and 80 exhibiting disparate first and second bevel angles $\theta_{B1}$ and $\theta_{B2}$.

Without reference to a work piece WP, the operative rotation direction $D_C$ is such that the first blade-edge location $L_{BE1}$ of each cutting knife 50 leads the second blade-edge location $L_{BE2}$ of that same cutting knife. Conversely, relative to the cutting direction $D_C$, the second blade-edge location $L_{BE2}$ of any given cutting knife 50 "trails" or "follows" the first blade-edge location $L_{BE1}$ of that very same cutting knife 50. Referring to FIGS. 1 and 1A, the cutting direction $D_C$ is labeled, established and defined relative to the first blade-edge location $L_{BE1}$ and the second blade-edge location $L_{BE2}$ of each cutting knife 50. (The enlarged section shown in FIG. 1A shows the first and second blade-edge locations $L_{BE1}$ and $L_{BE2}$). In FIG. 1, the cutting direction $D_C$ is indicated as counter-clockwise by an arcuate arrow.

Consider, for purposes of comprehension, a horizontal axis passing though the blade rotation axis $A_R$ and extending left to right on the drawing sheet (there's a dashed line there that can be referenced for purposes of the present explanation). If the cutting blade 10 is rotated counter-clockwise as indicated in FIG. 1, then the first blade-edge location $L_{BE1}$ and, where applicable, the primary knife-edge portion 70, of each cutting knife 50 will pass across or "cut through" that axis (the dashed horizontal line) prior to the time that the second blade-edge location $L_{BE2}$ and, where applicable, the secondary knife-edge portion 80 of the very same cutting knife 50 will pass across or "cut through" that axis. This is true whether we consider a cutting knife 50 on either the left or the right side of the drawing sheet; the cutting knives 50 on the left side approach the reference axis under consideration from the top down, and the cutting knives 50 on the right side of the drawing sheet approach the reference axis from the bottom up, but, relative to each cutting knife 50 individually, the first blade-edge location $L_{BE1}$ crosses that reference axis prior to the second blade-edge location $L_{BE2}$.

Conversely to the cutting direction $D_C$ shown as counter-clockwise in FIG. 1, were the circular cutting blade 10 shown in FIG. 1 to be rotated clockwise instead, then the second blade-edge location $L_{BE2}$ of each cutting knife 50 would lead the first blade-edge location $L_{BE1}$ of the same cutting knife 50. However, the cutting blade 10 would not function if rotated thusly and, therefore, it makes sense to define the functional cutting direction $D_C$ as defined above relative to the first blade-edge location $L_{BE1}$ and/or, where applicable, primary knife-edge portion 70 of each cutting knife 50 "leading" the second blade-edge location $L_{BE2}$ and/or, where applicable, secondary knife-edge portion 80 of the same cutting knife 50.

Having established that the functional cutting direction $D_C$ can be defined relative to the first and second blade-edge locations $L_{BE1}$ and $L_{BE2}$ and/or the primary and secondary knife-edge portions 70 and 80 of each cutting knife 50, consideration is now given as to how this functional cutting direction $D_C$ can also be defined relative to a work piece being cut, as it is in the present specification and at least some of the claims appended hereto. Imagine the work piece WP shown in FIG. 1 being linearly urged toward either (i) the blade rotation axis $A_R$ along a radial line or (ii) toward the right side of the drawing sheet along a horizontal plane (not shown) parallel to the horizontal dashed reference line in FIG. 1 discussed above. As the blade 10 is rotated counter-clockwise as indicated in this case, AND the work piece WP is advanced into the cutting blade 10 as described, it is easy to appreciate that, as the blade 10 is slicing through the work piece WP, the first blade-edge location $L_{BE1}$ of or along each cutting knife 50 would enter into the work piece WP (from above) prior to the entry into the work piece WP of the second blade-edge location $L_{BE2}$ of or along the same cutting knife 50.

Another way of expressing that the first blade-edge location $L_{BE1}$ and/or primary knife-edge portion 70 of each cutting knife 50 enters the work piece WP prior to the second blade-edge location $L_{BE2}$ and/or secondary knife-edge portion 80 of that same cutting knife 50 in the manner explained above is to state that the work piece WP first encounters the first blade-edge location $L_{BE1}$ and/or primary knife-edge portion 70 of each cutting knife 50 before encountering the second blade-edge location $L_{BE2}$ and/or secondary knife-edge portion 80 of that (i.e., the same) cutting knife 50. Based on the preceding explanation and analysis, it would be equally clear, definite and valid to state, relative to each cutting knife 50, that "the work piece WP is encountered first by the first blade-edge location $L_{BE1}$ corresponding to a minor blade radius $R_{MIN}$ before being encountered by the second blade-edge location $L_{BE2}$ corresponding to the major blade radius $R_{MAJ}$."

The foregoing is considered to be illustrative of the principles of the invention. Furthermore, since modifications and changes to various aspects and implementations will occur to those skilled in the art without departing from the scope and spirit of the invention, it is to be understood that the foregoing does not limit the invention as expressed in the appended claims to the exact constructions, implementations and versions shown and described.

What is claimed is:

1. A circular blade configured for cutting meat when turned about a rotation axis in a predetermined cutting direction, the cutting blade comprising:

a single overall peripheral blade edge; and a plurality of circumferentially disposed cutting knives, each of which cutting knives includes (i) mutually convergent first and second knife sides, and (ii) an arcuate knife edge that is defined by the first and second knife sides, constitutes a portion of the peripheral blade edge, and rises, relative to the rotation axis, between a first blade-edge location corresponding to a minor blade radius and a second blade-edge location corresponding to a major blade radius, wherein (a) each knife edge is tilted such that an arc-bisecting line that bisects the knife edge at an arc mid-point, and that is oriented orthogonally to a tangent line including the arc mid-point, is non-parallel to a blade-radius line extending from the rotation axis through the arc mid-point;

(b) the second blade-edge location of each cutting knife is situated, relative to the cutting direction, behind the first blade-edge location of the same cutting knife such that, when the circular blade is rotating and cutting a work piece, the work piece first encounters the first blade-edge location of each cutting knife before encountering the second blade-edge location of that cutting knife;

(c) the peripheral blade edge further comprises a plurality of back slopes, each back slope is situated, relative to the cutting direction, behind the second blade-edge location of a first cutting knife and in front of the first blade-edge location of a second cutting knife located behind, and adjacent to, the first cutting knife; and (d) each back slope slopes more steeply than the knife edges between which that back slope is situated.

2. The circular cutting blade of claim 1 wherein the first and second knife sides of each cutting knife mutually converge to define a double bevel.

3. The circular cutting blade of claim 1 wherein the first and second knife sides of each cutting knife mutually converge to define a single bevel.

4. The circular cutting blade of claim 1 wherein the each back slope is configured and sloped such that, relative to that back slope, there exists a blade radius line that emanates from the rotation axis and passes through that back slope without passing through either of the two cutting knives between which that back slope is situated.

5. The circular cutting blade of claim 4 wherein the first and second knife sides of each cutting knife mutually converge to define a double bevel.

* * * * *